US006805271B2

(12) United States Patent
Holden

(10) Patent No.: US 6,805,271 B2
(45) Date of Patent: Oct. 19, 2004

(54) SINGLE HAND, PAPER TOWEL SHEET DISPENSER

(75) Inventor: William Holden, Durango, CO (US)

(73) Assignee: Holden Art Inc., Durango, CO (US)

( * ) Notice: Subject to any disclaimer, the term of this patent is extended or adjusted under 35 U.S.C. 154(b) by 0 days.

(21) Appl. No.: 09/955,220

(22) Filed: Sep. 19, 2001

(65) Prior Publication Data

US 2002/0033406 A1 Mar. 21, 2002

Related U.S. Application Data

(63) Continuation-in-part of application No. 09/664,751, filed on Sep. 19, 2000.

(60) Provisional application No. 60/284,889, filed on Apr. 20, 2001.

(51) Int. Cl.[7] ..... B26F 3/02; B65H 16/04; B65H 23/188

(52) U.S. Cl. ..... 225/106; 225/47; 225/51; 225/84; 206/409; 242/419.4; 242/592; 242/597; 242/599.2

(58) Field of Search ..... 225/82, 84, 85, 225/86, 51, 46, 47, 96, 96.5, 106; 242/590, 592, 597, 599.2, 599.3, 599.4, 419.4; 206/409

(56) References Cited

U.S. PATENT DOCUMENTS

| | | | | | |
|---|---|---|---|---|---|
| 12,674 | A | * | 4/1855 | Duryea | 225/84 |
| 320,576 | A | * | 6/1885 | Myers | 225/85 |
| 393,629 | A | * | 11/1888 | Ehrlich | 225/85 X |
| 404,321 | A | * | 5/1889 | Tivy et al. | 225/84 X |
| 405,402 | A | * | 6/1889 | Ehrlich | 225/82 X |
| 436,789 | A | * | 9/1890 | Jobes | 225/85 X |
| 751,920 | A | * | 2/1904 | Jones | 225/82 X |
| 842,959 | A | * | 2/1907 | Kaufman | 225/86 X |
| 1,038,150 | A | * | 9/1912 | King | 225/82 X |
| 1,063,787 | A | * | 6/1913 | Evans | 225/85 X |
| 1,325,300 | A | * | 12/1919 | Kundtson | 225/85 |
| 1,684,190 | A | * | 9/1928 | Moser | D6/523 X |
| 2,156,502 | A | * | 5/1939 | Lawton | 225/86 X |
| 2,181,207 | A | * | 11/1939 | Sanford | D6/523 X |
| D155,897 | S | * | 11/1949 | Huntington | D6/523 |
| D179,846 | S | * | 3/1957 | Gralewicz | D6/523 |
| 3,067,963 | A | * | 12/1962 | Suggs | D6/523 X |
| 4,556,160 | A | * | 12/1985 | Kurz et al. | 225/67 |
| 4,660,715 | A | * | 4/1987 | Anastos | 208/0.8 |
| 4,771,966 | A | * | 9/1988 | Anderson | 225/51 X |
| D374,585 | S | * | 10/1996 | Moon | D6/523 |
| 5,651,487 | A | * | 7/1997 | Hansen | 225/84 X |
| 5,727,721 | A | * | 3/1998 | Guido et al. | 225/46 X |
| 6,267,322 | B1 | * | 7/2001 | Harmathy | 225/84 X |

* cited by examiner

*Primary Examiner*—Charles Goodman
(74) *Attorney, Agent, or Firm*—Scott Houtteman; Bradford Kile; Kile Goekjian Reed & McManus

(57) ABSTRACT

The present invention is directed to a single hand, paper towel sheet dispenser comprising a base and a core holder operable to hold a roll of paper towel segments. A paper towel dispensing bale is pivotally connected to the base, the dispensing bale includes in inner brake bar and an outer tear bar such that a roll of paper towel sheets mounted upon the core holder can be generally trained in an under/over path for braking rotation of the roll during a one handed dispensing operation.

12 Claims, 9 Drawing Sheets

SINGLE HAND, PAPER TOWEL SHEET DISPENSER

CROSS-REFERENCE TO RELATED APPLICATION

This application relates to and claims continuation-in-part priority of utility application Ser. No. 09/664,751 filed on Sep. 19, 2000 and full priority of Provisional Application Ser. No. 60/284,889 filed on Apr. 20, 2001. The disclosures of these earlier filed applications are incorporated herein by reference as though set forth at length.

BACKGROUND OF THE INVENTION

This invention relates to a novel paper towel sheet dispenser. More specifically, the present invention is directed to a single hand, paper towel sheet dispenser that does not require a user to hold a roll of serrated, paper towel sheets with one hand in order to facilely tear off a desired number of the paper towel sheets.

Paper towels are routinely used in kitchens, restaurants and other settings where food is prepared and served. No matter where food is served, paper towel dispensers are often used to dispense paper towel sheets to clean up spills or to clean tables, floors and kitchen appliances. In addition, paper towel dispensers are often used in recreational settings, in addition to garages, auto or wood working shops and in other work or recreational areas where people need to absorb or wipe-up a spill, dry a surface or simply clean and/or dry their hands. Paper towels are usually sold in a roll having a width of approximately eleven inches or so and sheets of approximately six to fifteen inches in length connected end-to-end along serrated tear lines. The paper towel sheets are wound upon a paper core of approximately an inch in diameter and sell with a retail diameter of the roll of about four to five inches in diameter.

Paper towels are often formed from one or two ply sheets of absorbent paper material. One brand of such paper towel product is known as BOUNTY, which is a registered trademark of the Procter & Gamble Company. This brand comes in sheet lengths of a few inches or so to approximately eleven-by-eleven inches square. Another brand is referred to as BRAWNY which is a registered trademark of the Fort James Corporation and is conventionally sold in a roll of sheets eleven inches wide by thirteen point eight inches in length joined end-to-end along serration tear lines. In certain instances, sheets of paper towels may have other length and width dimensions, however, most disposable paper towel rolls have periodic transverse serrations to facilitate separation of discrete lengths or sheets.

The above paper towel products are often dispensed by using a simple U-shaped bracket holder. These holders are usually designed to be mounted upon a vertical wall surface or beneath a horizontal wood cabinet by wood screws. Each end of the U-shaped bracket is designed to hold one end of the paper towel core or alternatively a rod can be axially extended through the center of the paper core and mounted at its ends between the U-shaped bracket or frame. At least one disadvantage of traditional paper towel dispensers, including a simple U-shaped bracket holder, is that a person usually needs to use both hands to dispense the paper towels. This disadvantage represents an inconvenience and difficulty for some people, when one hand is holding a container, object of use, or is otherwise soiled or occupied. In such moments, the only option, in most instances, is for a person to find a place to set the container or other object of use so that both hands are free to tear off one or more sheets of paper towels. If a user attempts to use inertia and jerk a few sheets of towel from a roll, the roll often unreels. The user is then left with the task of rewinding unused lengths of towel segments. In other instances, if a user attempts to use inertia to tear sheets from a paper towel roll, the entire roll may be pulled off the holder. The user must then pick up the roll rewind any useful portion and reposition the roll on the holder. Still further, if a roll of towels is held with one hand, and a length of towel ripped off with the other, the sheets of paper towels may not tear at the serrated edges between individual sheets. This leaves uneven or jagged edges or strips of paper sheets hanging from the roll.

It would therefore be highly desirable to provide a means for dispensing different types of serrated, paper, towels that only requires a user to use a single hand to facilely tear off any length of paper towel desired in a reliable and convenient manner. In addition, it would be desirable to provide a means for dispensing serrated paper sheets wherein a user can use a single hand to tear off serrated, paper towel sheets without touching or soiling other sheets of the roll of paper towels with a user's hand.

Traditional paper sheet dispensers, including dispensers for paper towels, are often poorly designed or cheaply produced which means that a roll of paper towels often falls off the dispenser when a person attempts to tear off a segment. Therefore, it would be desirable to provide a paper sheet dispenser that is rugged and reliable in design and function and will securely retain a roll of paper towels during a dispensing procedure.

At least one paper towel dispenser, known in the past, that is designed to operate with one hand, includes a pair of nesting plastic yokes that are pivotally connected to a base plate. In this design, a paper towel roll is mounted on one of the yokes and trained over a top edge of the other yoke for tearing by a downward movement. In one embodiment this tearing operation is enhanced by use of tooth-shaped projections or a sharp blade fitted at an edge of the second yoke to assist in separating a desired length of towel from a roll This design, although more convenient than most traditional roll dispensers, is composed of relatively lightweight plastic and a multipart mounting mechanism for the yokes. Accordingly, this design lacks ruggedness and does not take advantage of gravity to assist in a dispensing process. Moreover the tear mechanism is simply an over a yoke bar design that is lacking user friendliness for a one handed operation.

In at least one further prior design, a roll of paper towels was operably received within a trough with a slit along one edge of the bottom of the trough. A free end of the roll of towels was trained through the slit and therefore operated as a dispensing unit. In this device there is nothing to brake rotation of the roll, except a user's second hand, and therefore while this design will dispense towel segments it exhibits many of the limitations of prior designs.

Traditional paper sheet dispensers do not provide an effective mechanism for limiting the unreeling of a roll of paper towels except with the use of two hands. If would be desirable to enable a user to dispense one or more paper towel sheets using a single hand. Moreover, it would be useful to enable a user, relying on just one hand, to be able to reliably and conveniently dispense paper sheets from a dispenser mounted either against a wall or under a cabinet.

In the past paper sheet dispensers also do not have means for mounting the dispenser in different positions in a manner that provides for alternative left or right side loading of a roll of serrated, paper towel sheets on the dispenser and reliable single hand operation of the dispenser. Bi-directional loading and operation of a paper towel sheet dispenser enables a user to use a single hand to tear off a desired number of sheets of paper towels from either the left side or right side of the dispenser in a reliable and convenient manner. Therefore, it would be desirable to provide a means for dispensing serrated, paper towel sheets such that the dispensing unit can be mounted in different positions, such as against a generally vertical surface or in a generally horizontal mounting position such as under a cabinet, either in a kitchen or other work or recreational area, wherein the dispensing means is designed for reversible loading and operation. Such dispensing means would enable a user to reliably and conveniently mount a serrated, paper sheet, dispenser on either the right side or left side of a generally planar surface, for convenient dispensing of serrated, paper towel sheets. It would also be desirable to provide a means for dispensing serrated, paper towel sheets that can be mounted on a wood or plastic surface with screws or on a metallic surface by utilizing a permanent magnet, and optionally wherein the base may be utilized to display personal or decorative pictures or designs or information for ready reference.

It would further be desirable, in at least one embodiment of the invention, to provide a means for dispensing serrated paper sheets, including paper towels, wherein the dispensing means is composed of heavy gauge wire material or other construction which provides not only strength to the structure but also a significant gravity component that assists in braking action during removal of a length of paper segments from a roll by a user using a single hand during a dispensing operation.

In addition, it would be desirable to provide a means for dispensing serrated paper sheets, including paper towels, wherein a torsion spring or elastic band facilitates a wall mount or under-cabinet operation of the serrated paper sheet dispensing means at a plurality of angles with respect to a base of the dispenser. In wall and under-cabinet mounting positions, such a device as a torsion spring or an elastic band can function to keep tension between the dispensing unit and the roll of serrated paper sheets. When such a device is present, the serrated, paper towel sheet dispensing means can also be mounted vertically.

Still further, since paper towels are usually located in user traffic areas, it would be desirable to provide a single hand, serrated, paper towel, sheet dispenser that is operable to display a photograph or item of decoration or personal interest. In this, it would be desirable to have the base component of such a dispenser optionally fitted with a photo frame, a tile frame, or a stainless steel (long, narrow metal) element These frame options operably receive a flexible magnet on the reverse side, or other mounting arrangement.

In view of the limitations of traditional paper towel sheet dispensers, it would be therefore be desirable to provide a means for dispensing serrated paper towel sheets that enables a user to dispense serrated paper towel sheets with a single hand in a reliable and convenient manner, and which incorporates novel, desirable elements referred to above.

The difficulties and limitations suggested in the preceding are not intended to be exhaustive, but rather are among many which demonstrate that paper towel dispensers appearing in the past will admit to worthwhile improvement.

OBJECTS OF THE INVENTION

It is a general object of the invention to provide a single hand, serrated, paper towel, sheet dispenser that will obviate or minimize problems and achieve desired advantages of the type previously described.

It is a general object of the invention to provide a single hand, serrated, paper towel sheet dispenser wherein a desired length of one or more serrated paper towel sheets, may be facilely removed by one free hand without using a second hand that may be in use, soiled or otherwise occupied.

It is a general object of the invention to provide a bi-directional, single hand, serrated, paper towel dispenser wherein the dispenser may be mounted in a position for loading and dispensing paper towels on either the right side or left side of a base plate, such that a user may use a single hand to operably dispense a desired length of serrated paper sheets when the dispenser is mounted on either the right side or the left side of a base plate.

It is another object of the invention to provide a bi-directional, single hand, serrated, paper towel sheet dispenser wherein a user can slide the dispensing unit out of a base plate, and reinsert the dispensing unit in the reverse side of a base plate for loading and dispensing of serrated paper sheets.

It is another object of the invention to provide a bi-directional, single hand, serrated, paper towel sheet dispenser wherein the dispenser may be operably mounted on vertical wood, plastic or metal surfaces or beneath horizontal surfaces such as cabinets.

It is yet another object of the invention to provide a bi-directional, single hand, serrated, paper towel dispenser wherein a mounting bracket can be used to secure the paper sheet dispenser in a stationary position and prevent undesired movement of the dispenser during a paper sheet dispensing operation.

It is yet another object of the invention to provide a bi-directional, single hand, serrated, paper towel dispenser wherein the dispenser continues to be highly effective in use, with only one hand, even as the size of the roll of serrated paper sheets decreases.

It is yet a further object of the invention to provide a bi-directional, single hand, serrated, paper towel dispenser wherein a user may operably display messages, or photographs or other items of a personal nature with the bi-directional, serrated, paper towel sheet dispenser.

It is yet another object of the invention to provide a bi-directional, single hand, serrated, paper towel dispenser wherein the core of the dispenser is securely retained and will not allow a serrated, paper towel sheet to slip off of the dispenser when a paper sheet segment is torn from the dispenser.

It is a further object of the invention to provide a bi-directional, single hand, serrated, paper towel dispenser where the core of the serrated paper sheet dispenser may be securely held against wobble and undesired unreeling while permitting selective rotation to permit controlled single hand dispensing of serrated, paper towel sheets, including paper towel sheets.

It is still another object of the invention to provide a bi-directional, single hand, serrated paper sheet dispenser wherein a roll of serrated paper towel sheets is automatically and securely retained to prevent rotation as a sheet of paper towel is torn from the roll.

It is yet a further object of the invention to provide a bi-directional, single hand, serrated paper sheet dispenser wherein undesired unreeling of long lengths of serrated paper sheets is avoided even though a selective length of a serrated paper sheet segment is torn off with a single, one handed, stroke.

It is yet another object of the invention to provide a bi-directional, single hand, serrated, paper towel sheet dispenser wherein engagement of the surface of a roll of paper towel sheets is enhanced to facilitate a one handed dispensing operation.

Still further, it is an object of the invention to provide a bi-directional, single hand, serrated, paper towel sheet dispensing system that during the sequence of tearing off a paper towel sheet will concomitantly leave a short segment of a next serrated, paper towel sheet to grasp for a subsequent dispensing operation.

BRIEF SUMMARY OF A PREFERRED EMBODIMENT OF THE INVENTION

A preferred embodiment of the invention, which is intended to accomplish at least some of the foregoing objects, includes a single hand, paper towel sheet dispenser comprising a base, a core holder operable to rotatably hold a roll of serrated, paper towel sheet segments connected together end-to-end along perforated tear lines, and a single hand paper towel dispensing bale. The single hand dispensing bale includes a first brake bar and a second generally parallel tear bar. The parallel bars of the single hand dispensing bale receives a length of paper towel in a dispensing path that operably secures the towel roll against rotation by the braking bar and concomitantly provides a tear bar, separated from the roll of paper towel sheets, such that individual sheets of a segmented paper towel roll can be facilely dispensed with one hand.

BRIEF DESCRIPTION OF THE DRAWINGS

Other objects and advantages of the present invention will become apparent from the following detailed description of preferred embodiments thereof taken in conjunction with the accompanying drawings, wherein.

DETAILED DESCRIPTION

Figure 1:
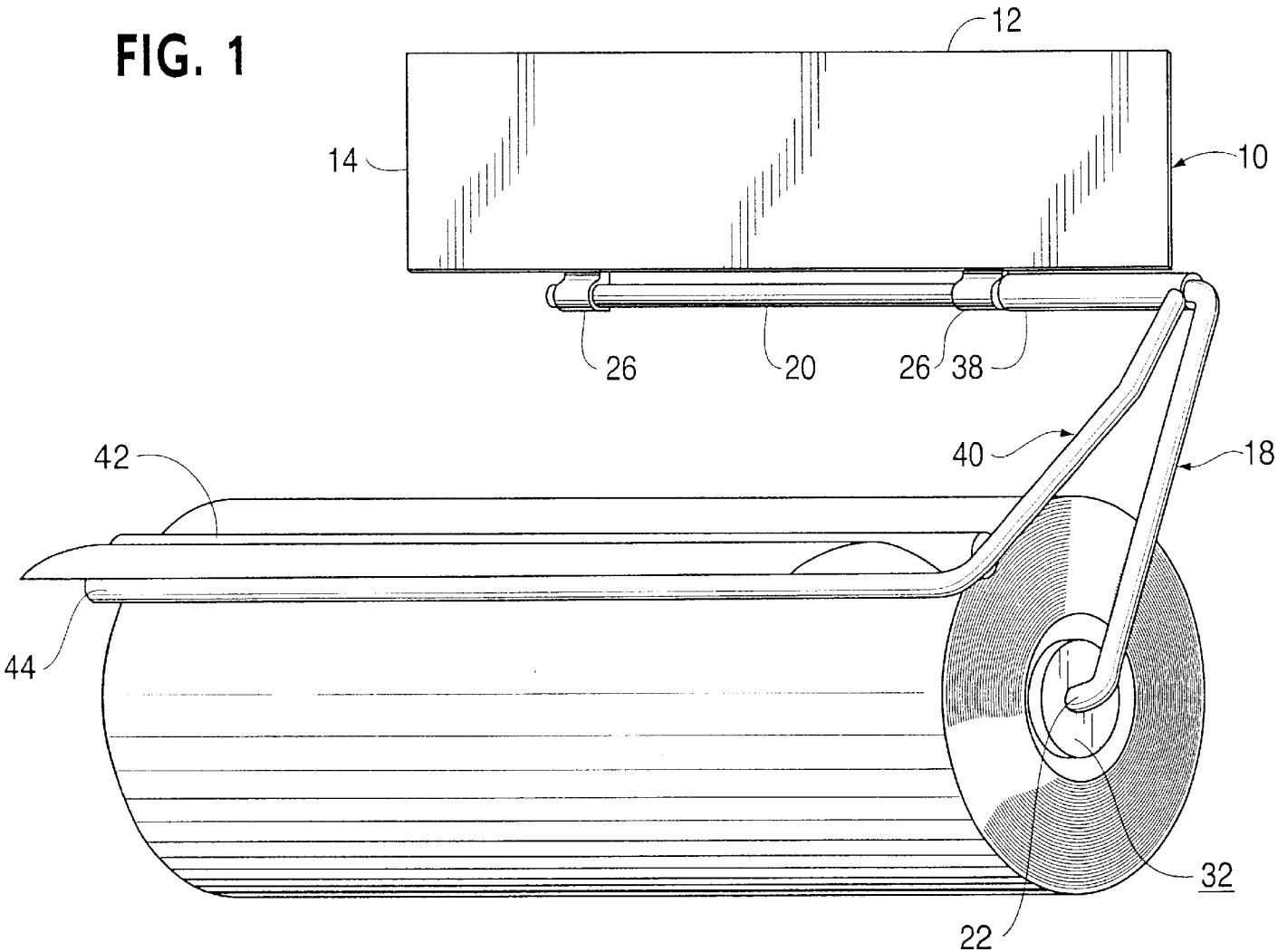
FIG. 1 is an axonometric view of a bi-directional, single hand, paper towel sheet dispensing device in accordance with one preferred embodiment of the invention.

The invention is directed to a novel paper towel sheet dispenser. The dispenser comprises a base for mounting to a support surface, a core holder operable for carrying a roll of segmented paper towel sheets, and a paper towel-dispensing bale. The dispensing bale includes a pair of mutually parallel and cooperating bars, which are pivotally connected to the base. One of the bars contacts a towel surface for braking rotation of a roll of paper towel segments and the other bar provides a tear surface operable for dispensing the paper towel sheets with one hand.

The paper towel sheet dispenser can be mounted on a generally vertical surface or alternatively mounted on a horizontal surface such as the bottom of a kitchen cabinet. The base can be fitted with a magnet to enable the base to be releasably fixed to a vertical metallic surface such as a refrigerator exterior sidewall. In all of the mounting arrangements, a dispensing bale having mutually parallel bars, is used to allow a user to load a roll of paper towels onto the core carrying member and train a free end of the roll of paper towels beneath a braking bar and over a tear bar so that downward tearing motion of the towel over the tear bar concomitantly pivots the braking bar into secure braking engagement with an exterior surface of the roll of paper towels. The result is a smooth removal of a desired number of sheets of the paper towel roll, with one hand, and concomitant positioning of a neat, short segment of towel for grasping during the next dispensing operation.

Single Hand, Paper Towel Sheet Dispensing Apparatus

Referring now to the drawings, wherein like reference numerals indicate like parts, there will be seen preferred embodiments of the subject invention.

In FIGS. 1 through 5, one preferred embodiment of the invention is shown in accordance with the invention. In this embodiment of the invention, a base member 10 is formed from a generally rectangular member, which is operable to be mounted on a vertical or horizontal surface. The base member has a length 12 which may be about half the width of a conventional roll of paper towels. The height 14 of the base is preferable somewhat less than the length, although the reverse can also be true depending upon the intended application. In a presently preferred embodiment, the base is approximately six inches long and approximately four inches high. Mounting apertures (not shown in FIG. 1, 2 or 3) may be fashioned through the base to receive wood screws in a conventional manner. In a preferred form the base is fabricated as a generally rectangular or square stamped metallic shell. The shell can carry a solid rectangular permanent magnet. Alternatively, the base may be round, oval, square or even irregular as desired. The base may be releasably mounted upon the exterior of any metallic surface such as the sidewall, or even front, of a refrigerator. The base element 10 can also be configured such that a transparent cover is mounted on top of the base element to permit display of pictures or other personalized user insignia. In another form the base can be formed from a ceramic block with a magnetic backing adhesively adhered to the base.

Figure 2:
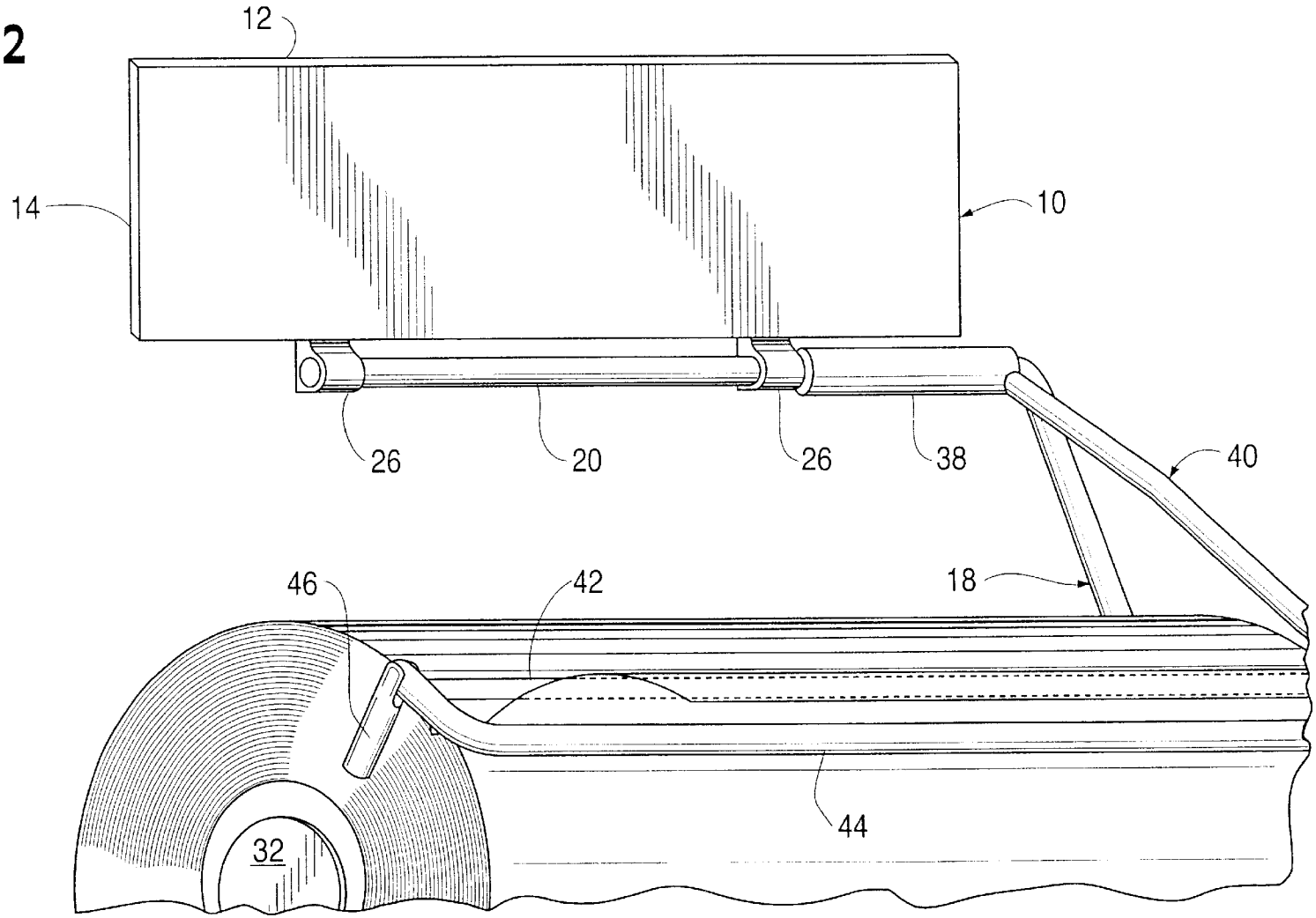
FIG. 2 is another perspective axonometric view of a single hand, paper towel sheet dispensing device in accordance with the preferred embodiment of the invention depicted in FIG. 1, wherein a distal end of a dispensing bale is shown which functions to retain a roll of paper sheets on a core holder.
Figure 3:
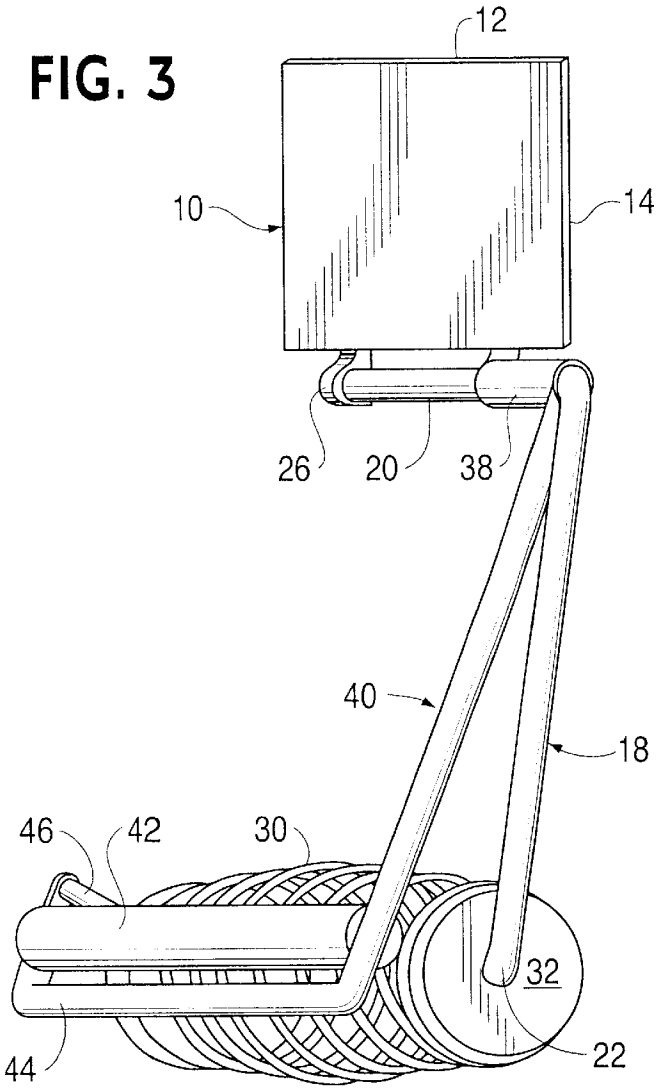
FIG. 3 is another perspective axonometric view of the subject invention, as depicted in FIG. 1, with the components of the invention shown assembled together without application of a roll of paper towels to reveal structural details of the invention.

The base 10 operably serves to carry a generally U-shaped wire core holder 18. The core holder 18 has a first rod 20 pivotally mounted on the base 10. This can be accomplished by different means, including an elongate sleeve segment (not shown) stamped out of the metallic member 10 or two or more sleeve segments 26 connected to the lower portion of the base 10. The core holder 18 has a second rod 22, extending parallel to the first, that serves to pivotally carry a core-carrying member 30, note FIG. 3. The core-carrying member 30 may be formed in a number of generally cylindrical shapes, including a spiral-shaped wire cage as depicted in FIG. 3. Another shape of the core-carrying member 30 can be a molded plastic unit that has voids throughout its length but is generally fashioned in the shape of a cylinder. Regardless of the material, or exact shape, the core carrying member 30 snuggly but releasably engages the interior surface of a paper core of a roll of paper towel sheets without relative rotation. The core carrying member 30, however, is pivoted upon and free to rotate about the second rod 22 of the core holder 18. The diameter of the core carrying member 30 can vary but is generally the size of a conventional paper core of a roll of paper towels. The distal end of the core carrying member ends with a disc 32, as depicted in FIG. 1, that is dimensionally operable to fit within the paper core of a roll of towels as shown in FIGS. 1 and 2.

In addition to the core holder 18 the base 10 operably carries, via a pivotal connection 38, a free hand dispensing bale 40. The dispensing bale is connected to the core holder 18 by a pivot sleeve 38.

The U-shaped core holder 18 and dispensing bale 40 are preferably composed of a heavy gauge solid wire construction so that they are rugged. Other materials and shapes such as tubular plastic bars are envisioned and may be used, however, a heavy wire composed of painted low-grade steel, or even stainless steel, is presently preferred.

The dispensing bale 40 is a generally U-shaped member fashioned with a pair of mutually parallel bars 42 and 44. A brake bar 42 is operable to extend transversely across and contact an exterior surface of a roll of paper towel sheets, mounted upon the core holder 18. A tear bar 44 operably extends transversely across the direction of unreeling of a roll of paper sheets and is mutually parallel with, but spaced from, the brake bar 42. In combination, the pair of bale bars 42 and 44 provides a path of unreeling for the free end of a roll of paper towel sheets.

As noted above the roll of paper towel sheets, is usually formed with transverse serrated or score lines across the sheets to facilitate separation. Accordingly, if a length of paper towel is drawn out, generally horizontally, or unreeled to a desired length, by a user's single hand, until a score line is an inch or two beyond the tear bar 44, downward angled motion by the user will pull the tear bar 44 down and the attached brake bar 42 will simultaneously be pulled into firm braking registry with the surface of the roll of paper towels. In addition, downward pivoting motion of the bale 40 and the core holder 18 serves to pin the side of the roll of paper towel sheet against a vertical wall carrying the base 10.

During the unreeling and tearing process the roll of paper towels may be additionally retained on the core support by the provision of a generally radially extending arm 46 at a distal end of the dispensing bale 40, as depicted in FIG. 2. The arm 46 may be pivoted with respect to the dispensing bale 40 and functions to maintain a roll of paper towel sheets on the core carrying bale 18 during an unreeling process.

Figure 5:
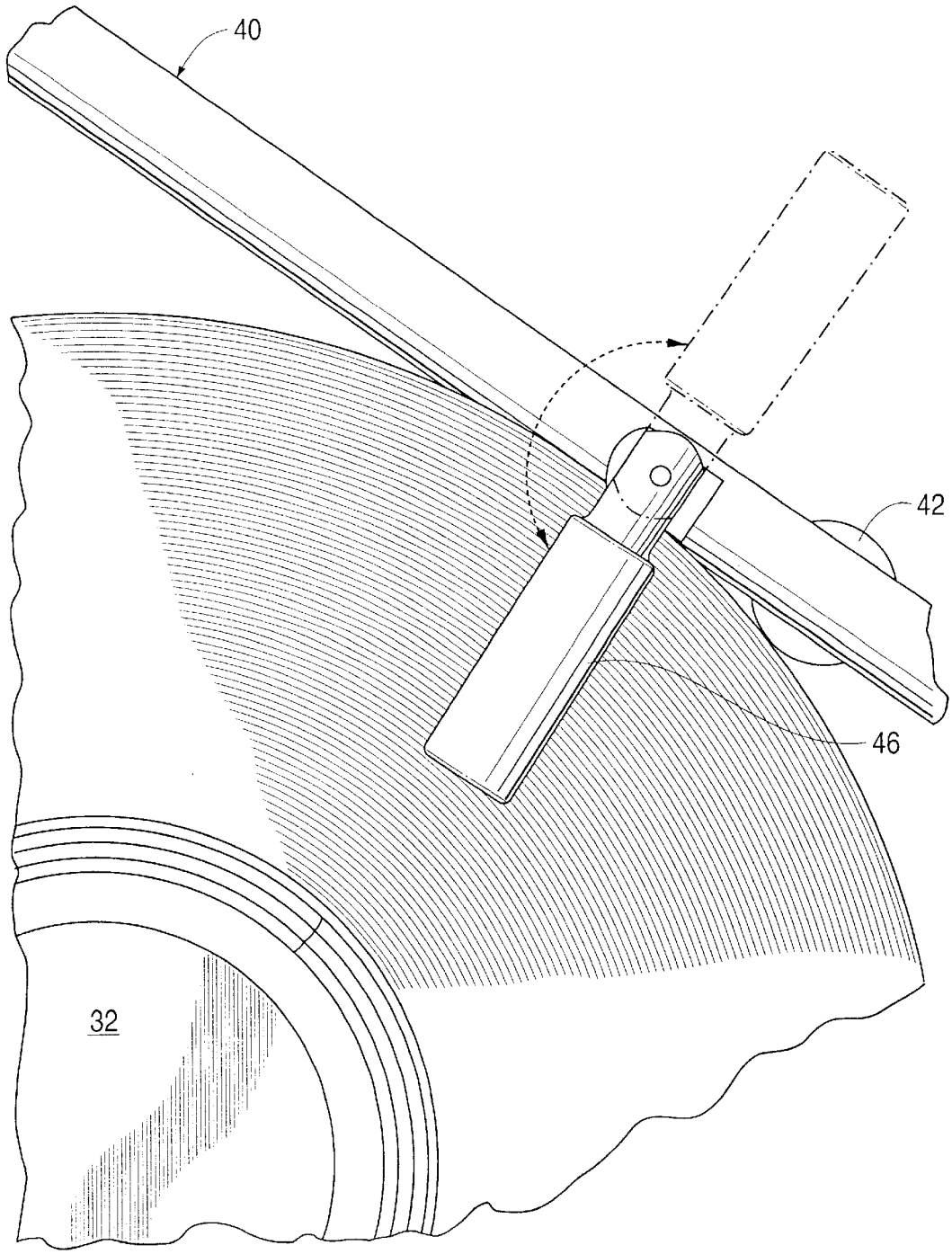
FIG. 5 is a partial end view of the dispensing bale, which depicts rotational operation of a distal end of the bale tear bar, in accordance with the bi-directional operation of the present invention.

As further depicted in FIGS. 1 and 2, the invention is designed to be bi-directional in that a user might want to install the serrated, paper towel sheet dispenser of the present invention so that the core carrying member 18 can be loaded from either the right side or left side of the dispenser. To make the dispenser bi-directional, a user slides the core carrying member 18 out of engagement with the base plate 10, then swings the dispensing bale 40 to the other side of the core carrying member 18. Then the user reinserts the core carrying unit 18 in the other end of the base plate 10, such that the mounting arm 20 is inserted through the mounting brackets 26 from the opposite direction. During this process, the distal arm 46 is rotated 180° to retain the roll of paper sheets on the core carrying member 28 as depicted in FIG. 2, is pivoted around 180 degrees as shown in FIG. 5. In the new position, the distal arm 46 is in a position, again, to retain the roll of paper sheets on the core-carrying member 18.

FIG. 3 depicts a perspective view of the subject invention with the components of the invention shown assembled together without application of a roll of serrated paper sheets to reveal structural details of the invention.

Figure 4:
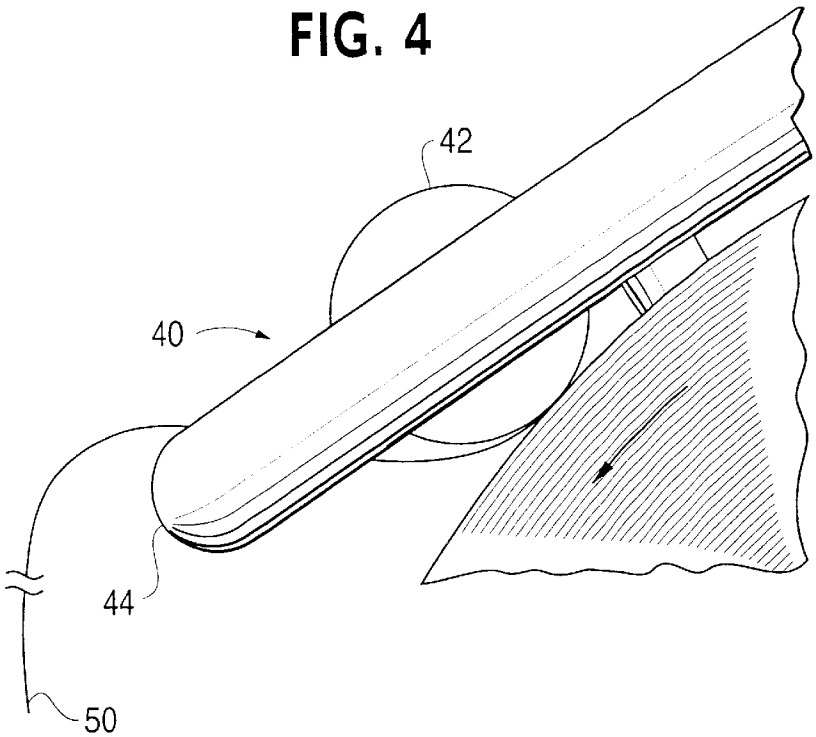
FIG. 4 is a partial end view of a bale portion of the present invention, and depicts one shape of a dispensing bale brake bar and tear bar combination, in accordance with one preferred embodiment of the invention.

FIG. 4 depicts a partial end view of the dispensing bale 40 where the diameter of the brake bar 42 engaging the exterior surface of the roll of paper towels has a diameter greater than the diameter of the tear bar 44. Accordingly, the tear bar 42 is held out and away from engagement with the exterior surface of a roll of paper towels. Gently pulling downward on the free end 50 of a roll of paper towels sheets unreels a length of towel beneath the brake bar 42 and over the tear bar 44. After a desired length is unreeled and a serrated line is extended an inch or so beyond the tear bar 44, a quick motion downward will put downward pressure on bar 44 which will force braking bar 42 against the roll of towels and create a clean, one handed tear, along the serration line of the roll of towels and brake further rotation of the roll of towels.

Figure 6:
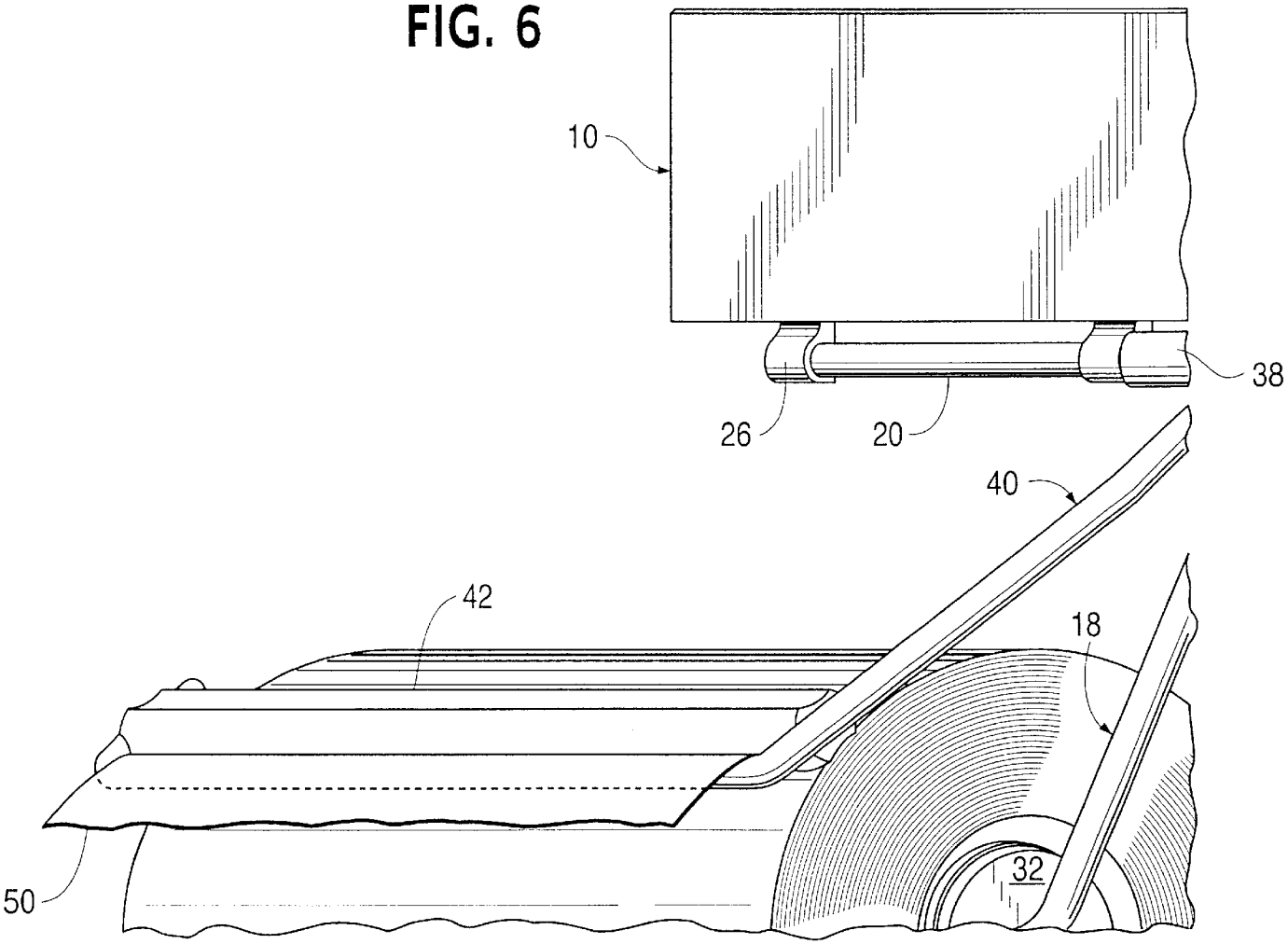
FIG. 6 is a partial, axonometric view of another embodiment of the present invention, and depicts a bale brake bar member.
Figure 7:
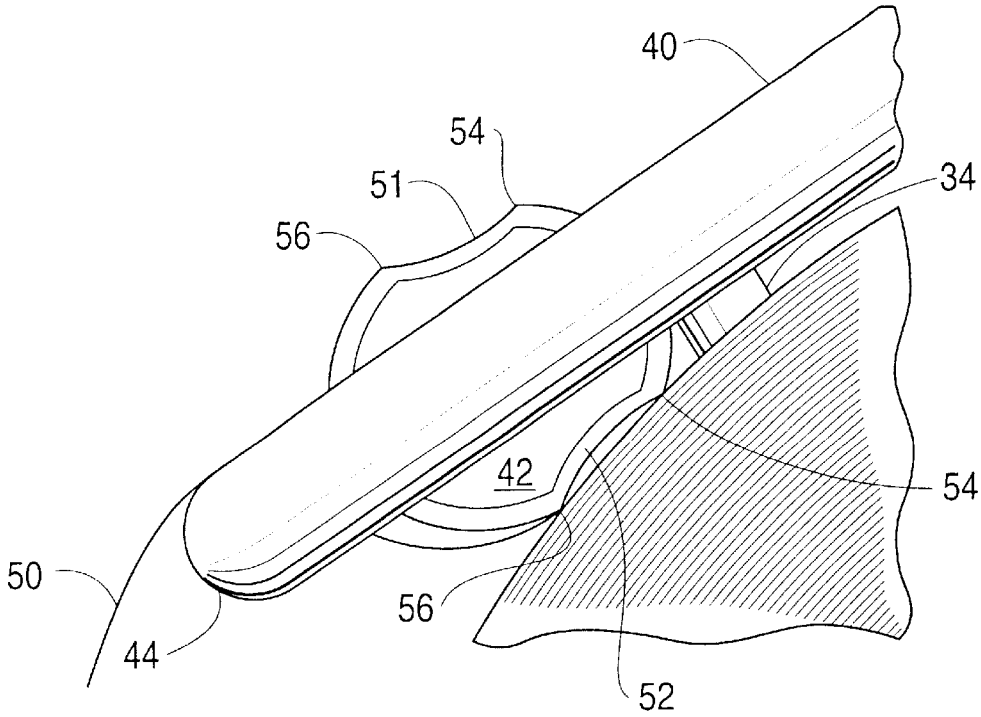
FIG. 7 is a partial end view of the bale brake bar depicted in FIG. 6 which discloses in detail an embodiment of a brake bar.

Turning now to FIGS. 6 and 7, there will be seen an axonometric and partial end view of an alternative preferred form of the dispensing bale 40. The interior brake bar 42 again is larger in cross-sectional dimension than the tear bar 44. However, in this embodiment the interior brake bar 42 is fashioned with opposing concave, longitudinal, depressions 51 and 52. These longitudinal depressions in the surface of the brake bar 42 provide mutually parallel ridges 54 and 56. The ridges shown in FIG. 7 serve to create a pair of parallel lines of pressure upon the exterior surface of a roll of serrated paper towels. The outwardly looking or top ridges, shown in FIG. 7, serve no function when the dispenser is mounted with the orientation to the base 10 as shown in FIG. 6. However, if the dispenser bale 40 is mounted from the other end of the base 10, i.e. turned end-for-end and the dispensing bale 40 is flipped over, the former outward looking lines of contact 54 and 56 will come into contact with the periphery of the roll of serrated paper towel sheets.

Figure 8:
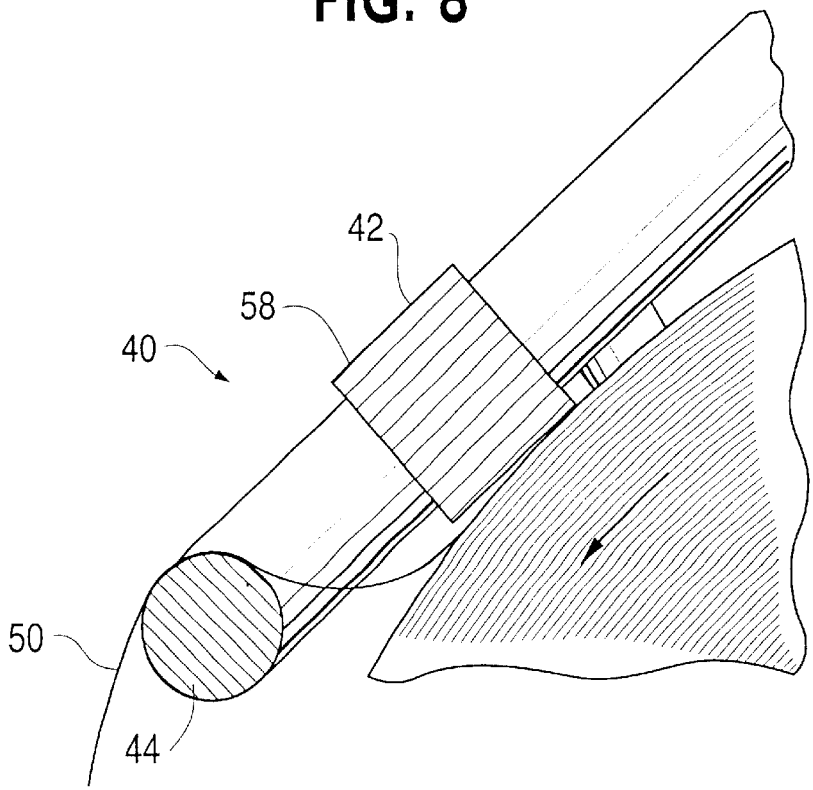
FIG. 8 is a partial cross-sectional view, similar in general orientation to FIG. 7, and depicting an alternate configuration of a bale brake bar in accordance with the invention.

Referring to FIG. 8, another alternative embodiment of the dispensing bale 40 is shown, having an inner brake bar 42 and an outer tear bar 44. In this embodiment the inner braking bar 42 is again larger in transverse dimension than the outer tear bar 44, however, in this embodiment the inner braking bar 42 is approximately square in cross-section having four sides 58 of approximately equal dimension. In this embodiment a generally flat, rectangular inner surface is brought into braking contact with the exterior surface of the roll of serrated, paper towels during a dispensing operation.

Figure 9:
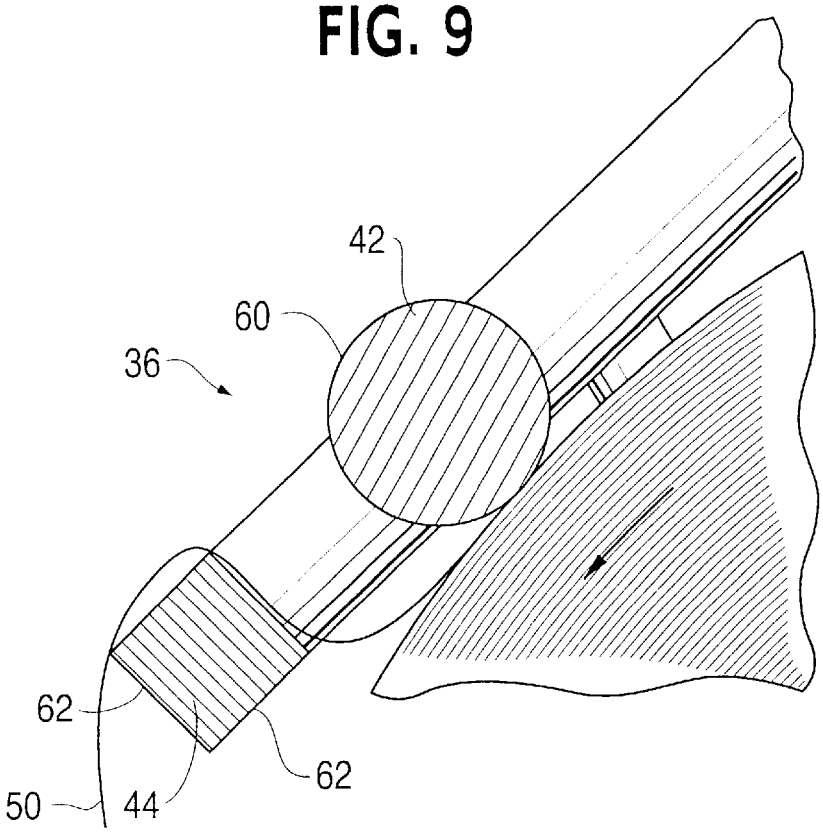
FIG. 9 is a partial cross-sectional view, similar in orientation to FIG. 8, showing an alternative exterior bale tear bar and brake bar combination in accordance with another embodiment of the invention.

Turning to FIG. 9, an embodiment of a dispensing bale 36 is shown where the inner brake bar 42 is a cylinder, as previously shown in FIGS. 3 and 4, with a substantially circular outer surface 60 and is larger in cross-section than the tear bar 44. However, in this embodiment the outer tear bar 44 is shown as a solid bar of square cross-section having sides 62 of approximately equal dimension. In this embodiment the outer bale presents a pair of contact edges for a paper towel sheet 50 being pulled downwardly over the outer bale during a tearing operation along a line of serrations in the roll of paper towels.

Figure 10:
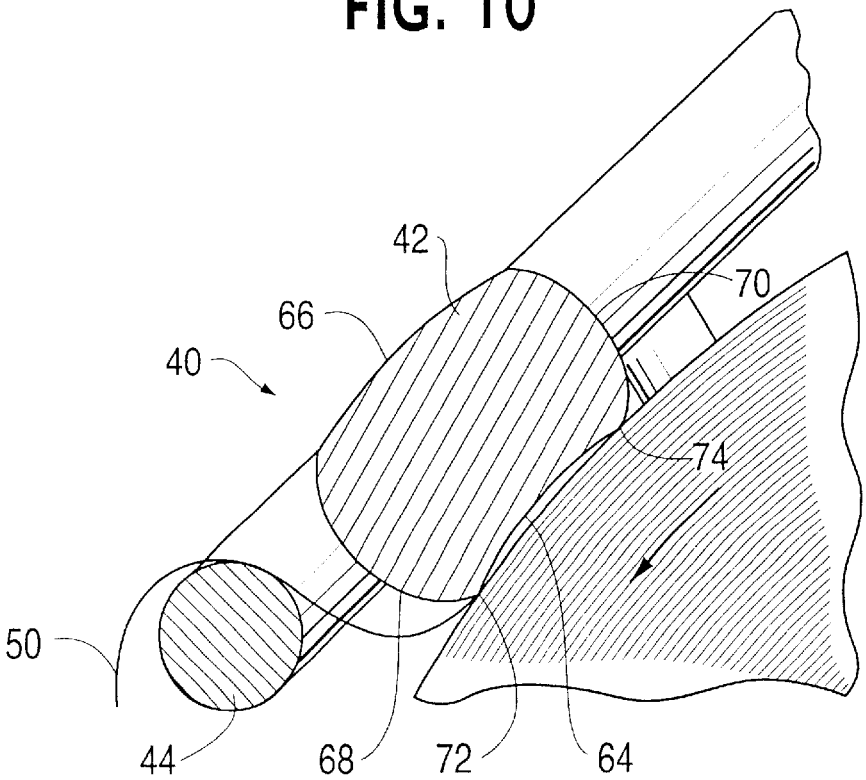
FIG. 10 is a partial cross-sectional view showing yet another alternative brake bar and tear bar combination.

FIG. 10 depicts yet another embodiment of a dispensing bale 40. In this embodiment the brake bar 42 is larger in cross-section then the tear bar 44, however, the shape of the brake bar 44 is not symmetrical and formed as an elongate bar having a cross-section with generally arcuate opposing sides 64 and 66 and arcuate ends 68 and 70. The curvature of the arcuate side 64 is approximately equal to the curvature of the exterior surface of a full roll of serrated paper towels and presents a generally conforming contact surface with the outer periphery of the roll of towels while having relatively spaced contact lines 72 and 74 as compared with the above discussed embodiments.

Figure 11:
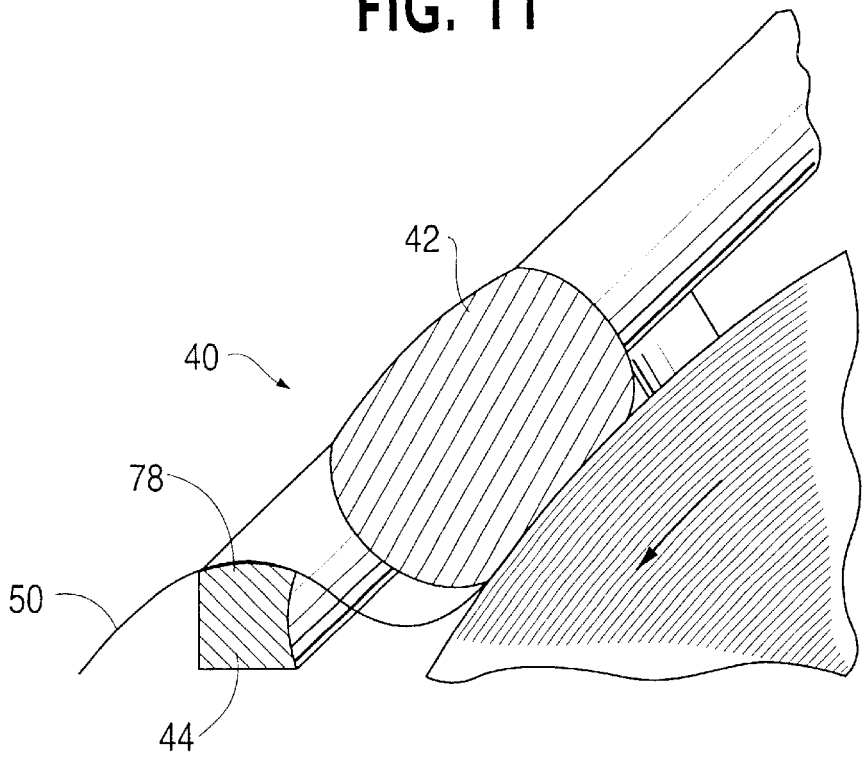
FIG. 11 is a partial cross-sectional view showing still another alternative embodiment of a brake bar and tear bar combination.

FIG. 11 discloses yet another embodiment of the dispensing bale 40 invention where the inner brake bar 42 is similar to the brake bar depicted in FIG. 10, however, the outer tear bar 44 is formed with a somewhat square cross-sectional configuration but with an arcuate upper surface 78 that contacts the paper towel 50 as it is being dispensed to present in combination with inner bale 42 a desirable braking and tear configuration.

Figure 12:
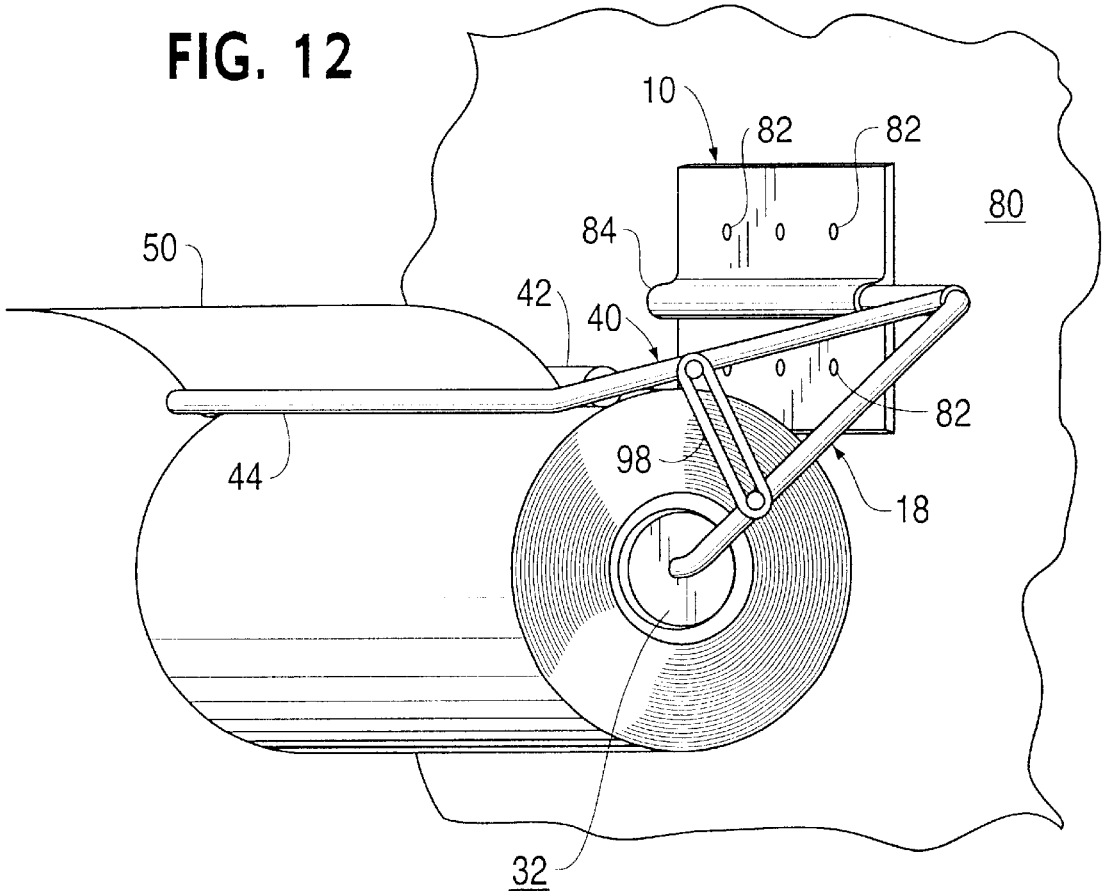
FIG. 12 is an axonometric view of another embodiment of the present invention and depicts in combination with FIGS. 13 and 14, a unique vertical, horizontal and angled mounting assembly of the subject invention.
Figure 13:
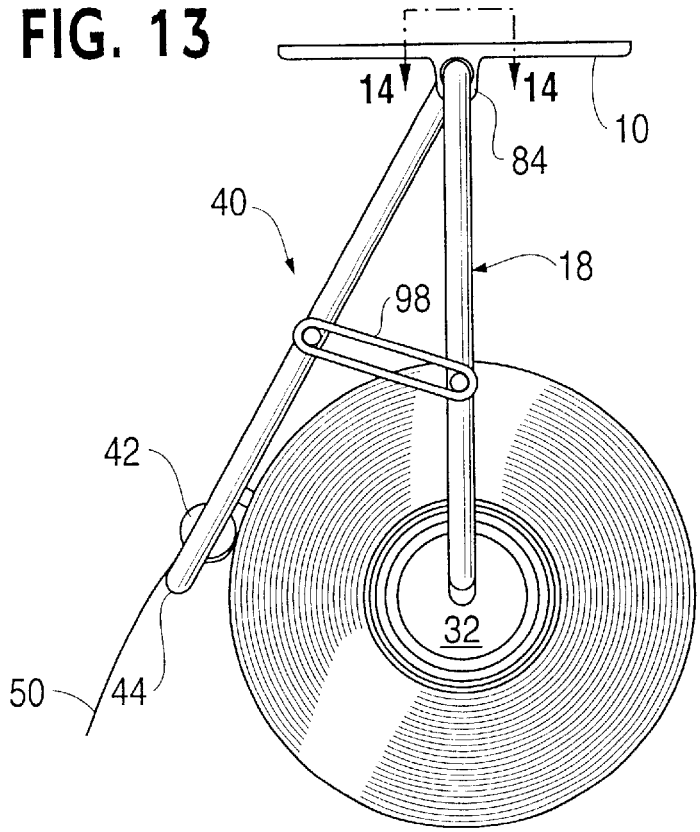
FIG. 13 is an end view of the embodiment of the present invention depicted in FIG. 12 but mounted onto a horizontal, generally planar surface, such as beneath a conventional wood kitchen cabinet with the paper towel roll carrying member and dispensing bale rotated with respect to the base as seen in FIG. 12.
Figure 14:
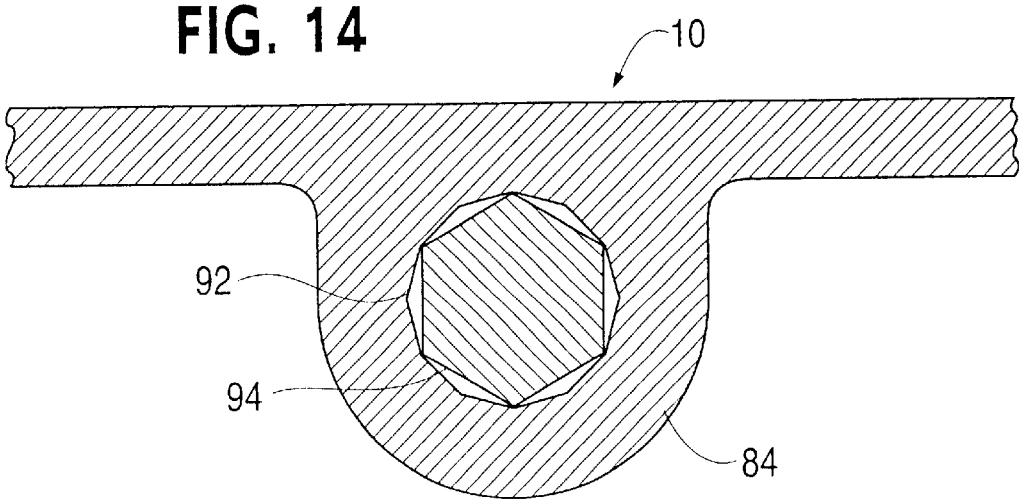
FIG. 14 is a cross-sectional view, taken along section line 14—14 in FIG. 13, of a mounting bar for selectively connecting the core carrier and dispensing bale at a desired angle with respect to a base plate.

FIGS. 12–14 illustrate yet another embodiment of the invention. FIG. 12 discloses an axonometric view of the components of the bale 40 mounted upon a base 10 where the bale components and roll of paper towels extend outwardly from a central portion of the base 10. Mounting apertures 82 may be fashioned through the base plate 10 to receive wood or metal screws in a conventional manner. For mounting on a vertical surface 80, as depicted in FIG. 12, the core holder 18 is mounted within a sleeve 84 formed within the base element 10.

FIG. 13 illustrates an end view of the subject invention depicted in FIG. 12 mounted onto a generally horizontal surface, such as beneath a cabinet. The components are essentially the same as discussed above in the sense of a core holder 18 and a single hand, paper towel sheet dispensing bale 40 being operably connected to a base 10 to pivot with respect to the base. In this embodiment, however, the core holder 18 is not pivotally connected to the base 10 but is rather mounted against rotation with respect to the base. Accordingly, downward motion of a dispensed sheet 50 of paper towel segments will pivot the paper towel dispensing bale 40 against the surface of the roll of serrated towel segments and brake unreeling as the towel segment is facilely torn off with one hand of a user.

FIG. 14 depicts a cross-sectional view, taken along section lines 14—14 in FIG. 13, of a mounting arrangement of the core holder 18 with respect to the base plate 10. The mounting sleeve 84 is an integral part of the base element 10 and extends along the length of the base as shown in FIG. 12. The mounting sleeve 84 is formed as a cylindrical tube having, on at least a portion of its length, a noncircular interior shape. As seen in FIG. 14 this non-circular shape is depicted as a twelve-sided configuration having twelve flat surfaces 92 and twelve obtuse angles 94. A mounting rod 20 of core holder 18 is designed to axially slide into the mounting sleeve 84, note again FIGS. 1–3. However, at least a portion of the mounting rod is formed with lands and angles which are compatible with surfaces 92 and 94. In this, a dodecagon configuration is preferred although a hexagon shape will also work. The mounting rod 20 may be retained in an axially secure position by frictional engagement, a detent, a set screw or other conventional mounting arrangement. The provision of a twelve sided dodecagon mounting arrangement enables a user to adjust the position of the core holder 18, with respect to the plane of the base 10 in increments of 30 degrees. If a finer adjustment is desired the number of angles and flats can be increased.

In addition to angular adjustment, the releasable nature of core holder element 20, with respect to the base 10, enables a user to withdraw the core holder from the mounting sleeve 84 and turn the core mounting element 18 end-for-end such that the paper towel dispenser may be positioned, with an open end in a position to easily slide a roll of paper towels onto the core carrying member 30. As shown in FIG. 5, when an alternative end-for-end mount is desired, the paper towel-retaining rod 46 is rotated 180 degrees.

Although, as stated above, it is preferable for the core-carrying member 30 to securely engage the interior surface of a core of paper towels, the subject invention will also operate, although not as facilely, with a core-carrying member that has a diameter less than the interior diameter of the core of paper towels and thus permitting relative rotation of the roll of paper towels upon the core-carrying member during an unrolling operation. In this embodiment, however, once a length of towels are to be torn off, the brake bar 42 serves to prevent further rotation and enables one handed tearing of a desired length of paper towels.

In the embodiment shown in FIGS. 12–14 an elastic fastening element 98 operable extends between the fixed core holder element 18 and the pivotally mounted dispensing bale 40. This biases the dispensing bale 40 into engagement with the surface of a roll of paper towels (note particularly FIGS. 12 and 13). Alternatively, a spring or torsion bar (not shown) could be fitted between the mounting sleeve 38 and the rod 20 to bias the dispensing bale 40 toward the core-carrying member 18.

After a roll of paper towels is loaded upon the core-carrying member 30, the roll can be retained on the core-carrying member 30 by the provision of the generally radially extending retaining arm 46 at a distal end of the dispensing bale 40.

In a dispensing operation, if a free portion of the roll of paper towels is pulled outwardly, unreeling motion is facilely achieved with one hand. When a desired length is withdrawn from the roll, such that a serration, tear line is exposed an inch or two, beyond the tear bar 44, the desired length 50 is pulled downward and slightly at an angle. This pulling movement or motion serves to pin the first bale bar 42 into braking contact with the exterior surface of the roll. Moreover, in the embodiment of FIGS. 1–5, where the core mounting bar 18 is free to rotate with respect to the base plate 40, an exterior surface of the roll of sheets is pulled into engaging contact with a wall surface. This second engagement with a wall surface enhances the braking action of the brake bar 42 and provides a secure and reliable brake against unwanted unreeling of the roll of towels during a dispensing operation.

In one embodiment of the invention, the base member 10 can be fitted with a clear panel of glass or plastic to enable a user to slide a picture or personal item behind the glass for display. In this embodiment the core holder 18 is pivotally mounted to the base plate 10 along an edge of the frame so that the clear surface is not obstructed. The operation of the paper sheet dispenser, including the core holder 18 and the paper sheet dispensing bale, operate the same as discussed above.

The paper towel sheet dispenser can be mounted on a generally vertical surface, including a wall or cabinet, or alternatively mounted on the bottom of a horizontal surface, i.e. the bottom of a kitchen cabinet with wood or metal screws through the base plate 10.

To dispense a serrated paper sheet segment, such as a paper towel segment, one pulls the serrated sheet beneath inner brake bar 42 of the mutually parallel bars of the dispensing bale member 40 and over outer tear bar 44 until a perforation line is a few inches past the outermost tear bar. A smooth pull downwardly, slightly at an angle, serves to sever the segment of towel sheets along the serration and simultaneously brake the roll of paper towels to prevent roll rotation during the tearing operation. The result is a smooth removal of a desired number of sheets with one hand and concomitant positioning of a neat short serrated segment for grasping with one hand during the next dispensing operation.

SUMMARY OF MAJOR ADVANTAGES OF THE INVENTION

After reading and understanding the foregoing description of preferred embodiments of the invention, in conjunction with the illustrative drawings, it will be appreciated that several distinct advantages of the subject single hand, paper towel, sheet dispenser are obtained.

The invention presents numerous advantages over traditional paper sheet dispensers and enables a user to reliably unreel a desired length of paper segments and sever the length with one hand. The subject invention is preferably composed of heavy gauge wire which provides not only strength to the structure but a gravity component that assists in braking action during removal of a length of paper segments from a roll. Alternatively other materials may be used, such as plastic, which will fall within the purview of the subject invention. The paper sheet dispensing bale with mutually parallel bars 42 and 44 enables the paper sheet to be entrained in an under/over dispensing path that is operable to securely brake the roll as an individual or series of towel segments are torn from the roll.

The design of the paper towel-dispensing bale enables a user to dispense one or more serrated paper sheets with one hand. In one embodiment of the subject invention, the parallel brake bar of the dispensing bale, may be fashioned such that in cross-section the contacting surface of the brake bar contacts the outer surface of a roll of serrated paper sheets with a surface that is concave, hollowed or arched inward relative to the adjacent, generally rounded outer surface of said roll of serrated paper sheets. In this design, at least two parallel lines of contact are made between the braking bar and the outer surface of the roll of serrated paper sheets. This design provides desirable tearing characteristics when a user dispenses one or more serrated paper sheets. Other cross-sectional designs of the brake bar 42 and tear bar 44 provide desirable braking and tear characteristics for particular paper towel compositions. In this, when a user dispenses a paper sheet, the downward force applied by the user to dispense the sheet applies a force against the braking bar. This downward force acts as a braking mechanism such that at least two parallel lines of contact are established between said generally concave contacting surface of the braking bar and the somewhat deformable outer surface of a roll of serrated paper sheets. This braking mechanism serves both to secure the roll of serrated paper sheets during the dispensing operation, and also prevents undesired unreeling of the roll.

The subject paper towel dispensing invention is designed to be mounted with an open end either to the right or left. A user can facilely install the serrated paper sheet dispenser of the present invention with an open end on either the right side or left side of a generally planar surface for mounting. To change the direction of mounting a user slides the core carrying unit out of engagement with the base plate, then swings the bale bar to the other side of the roller, and reinserts the unit in the reverse side of the base plate.

The invention will mount on a refrigerator with a magnetic base plate, or it will mount on a wall or under a cabinet with screws through the base plate.

When the invention is mounted under a cabinet, non-circular cooperating surfaces will secure the roller in a desired angular position. In a presently preferred embodiment an angular adjustment every thirty degrees of angular position is provided.

In an alternative mode of operation, a user may want the roll of serrated paper sheets to hang against a wall (similar to mounting on a refrigerator). In the wall and under-cabinet positions, it may be beneficial to use a torsion spring or an elastic cord to maintain contact between the braking bar and the roll of serrated paper sheets.

The base member 10 can be fitted with a photo frame, a ceramic tile frame, or a stainless steel long, narrow piece. These frame options also have a flexible magnet on the reverse sides.

In one embodiment of the invention, the base member 10 is fitted with a generally U-shaped frame that operably fits around three sides of the base to form a U-shaped channel. A clear panel of glass or plastic is slid into the frame and a user is then free to slide a picture or personal item behind the glass for display. In this embodiment the core holder 18 is then pivotally mounted to the base edge of the frame so that the display surface is not obstructed.

The subject invention provides a reliable system of using a single hand to tear off serrated, paper towel sheets without touching or soiling other sheets of the roll of paper towels with a user's other hand.

The base may be advantageously mounted on a wood or plastic surface with screws or on a metallic surface by utilizing a permanent magnet. The base may further be utilized to display personal or decorative pictures or designs or information for ready reference.

The foregoing preferred and alternative embodiments of the invention, and advantages of the invention, are not intended to be exhaustive but rather are illustrative of the invention and should not be construed to be limitations on the invention.

What is claimed is:

1. A single hand, paper towel sheet dispenser comprising:

a base operable to be mounted upon a generally planar surface;

a core holder for a roll of paper towel segments connected together end-to-end along transverse serrated tear lines, said core holder being connected to said base, said core holder being operable to rotatably support the roll of paper towel segments;

a single hand, paper towel sheet dispensing bale operably connected to said core holder and being free to pivot with respect to said core holder, said dispensing bale having a pair of mutually parallel bars extending in a posture generally parallel to a central longitudinal axis of said core holder and transverse to the roll of paper towel segments when said roll is operably mounted upon said core holder, and said pair of mutually parallel bars comprising, a brake bar operable to extend transversely across an contact an exterior surface of the roll of paper towel segments mounted upon said core holder, and said brake bar is generally circular in cross section with a longitudinally partitioned concave channel having mutually parallel crests on either side of the channel and extending along at least one side of said brake bar such that contact of said brake bar with the roll of paper towel segments is along the mutually parallel crests of the concave channel adjacent to the roll of paper towel segments to be dispensed; and a tear bar operable to extend transversely across a direction of unreeling of the roll of paper towel segments mounted upon said core holder and being spaced from said brake bar such that a free end of said roll of paper towel segments is facilely trained beneath said brake bar and over said tear bar, wherein unreeling of a desired number of paper towel segments is achieved with one hand to a position with a transverse serration line slightly past an outer surface of said tear bar and then angular movement of the desired number of paper towel segments against said tear bar will concomitantly force said brake bar to be pressed against the exterior surface of said roll of paper towel segments to brake rotation of the roll of paper towel segments and effect lateral tearing of the desired number of paper towel segments.

2. A single hand, paper towel sheet dispenser as defined in claim 1 wherein:

said core holder being pivotally connected to said base so that a roll of paper towel segments, when mounted on the core holder, is operable to pivot with respect to said base.

3. A single hand, paper towel sheet dispenser as defined in claim 1 wherein:

said core holder being adjustably connected, such that an angle of the core holder may be adjusted with respect to said base.

4. A single hand, paper towel sheet dispenser as defined in claim 3 wherein:

a mounting sleeve is connected to said base for receiving a corresponding mounting rod of said core holder, said mounting sleeve having an interior non-circular configuration compatible with an exterior non-circular configuration of said mounting rod to prevent relative rotation between said mounting sleeve and said mounting rod.

5. A single hand, paper towel sheet dispenser as defined in claim 4 wherein:

said non-circular configuration of said mounting sleeve is a dodecagon and said non-circular configuration of said mounting rod is a hexagonal in cross-section.

6. A single hand, paper towel sheet dispenser as defined in claim 1 wherein said brake bar has a cross-sectional area greater than a cross-sectional area of said tear bar causing said brake bar to contact the exterior surface of a roll of paper towel segments, while said tear bar is spaced from the exterior surface of the roll of paper towel segments.

7. A single hand, paper towel sheet dispenser as defined in claim 1 further comprising:

a retaining arm pivotally connected at a distal end of said dispensing bale and being operable to facilitate axial retention of a roll of paper towel segments on said core holder during a process of unreeling and tearing paper towel segments form the roll of paper towel segments.

8. A single hand, paper towel sheet dispenser as defined in claim 1 and further comprising:

means connected between said core holder and dispensing bale to operably bias said brake bar into resting contact with the exterior surface of a roll of paper towel segments mounted upon said core holder.

9. A single hand, paper towel sheet dispenser comprising:

a base operable to be mounted upon a support member;

a core holder operable to receive a roll of paper towel segments connected together end-to-end along transverse serrated tear lines, said core holder having a central longitudinal axis and being connected to said base; and a single hand, paper towel segment dispensing bale operably connected to said core holder and being free to pivot toward and away from said core holder, said bale having a pair of mutually parallel bars extending in a posture generally parallels with said central longitudinal axis of said core holder, said pair of mutually parallel bars comprising, a brake bar operable to extend transversely across and contact an exterior surface of a roll of paper towel segments mounted upon said core holder, and a tear bar connected to but spaced from said brake bar, said tear bar is circular in cross-section, said brake bar is greater in transverse dimensions than said tear bar and having at least two edges of said brake bar engaging the surface of a roll of paper towel sheets during a dispensing operation, said tear bar being operable to extend transversely across a direction of unreeling of a roll of paper towel segments and being spaced from said brake bar away from the roll of paper towel segments wherein a free end of said roll is facilely trained beneath said brake bar and over said tear bar such that unreeling of a desired number of paper towel segments is achieved with one hand and angled movement of the unreeled number of segments against the tear bar with on hand will concomitantly force said brake bar against the exterior surface of said roll of paper towel segments to stop rotation of the roll and effect lateral tearing of the desired number of paper towel segments.

10. A single hand, paper towel sheet dispenser as defined in claim 9 wherein:

said at least tow edges of said brake bar are mutually spaced and parallel operable for contacting an exterior surface of the roll of paper towel sheets for braking rotation of the roll of sheets during a dispensing operation.

11. A single hand, paper towel sheet dispenser as defined in claim 9 wherein:

said core holder is adjustable mounted with respect to said base; and means for adjusting relative angular relationship between said core holder bale and said base.

12. A single hand, paper towel sheet dispenser as defined in claim 11 wherein said means for adjusting comprises:

a dodecagon socket connected to said base; and a hexagon portion formed upon said core holder bale to provide angular adjustment in increments of thirty degrees.

* * * * *

UNITED STATES PATENT AND TRADEMARK OFFICE

CERTIFICATE OF CORRECTION

PATENT NO. : 6,805,271 B2
DATED : October 19, 2004
INVENTOR(S) : William Holden

It is certified that error appears in the above-identified patent and that said Letters Patent is hereby corrected as shown below:

Title page,
Item [73], Assignee, change "Holden Art Inc." to -- HoldenArt, Inc. --.

Signed and Sealed this

Fourth Day of April, 2006

JON W. DUDAS
*Director of the United States Patent and Trademark Office*